US011452346B2

(12) United States Patent
Loinger et al.

(10) Patent No.: US 11,452,346 B2
(45) Date of Patent: Sep. 27, 2022

(54) CUT FOR GEMSTONE

(71) Applicant: D. Swarovski KG, Wattens (AT)

(72) Inventors: Christian Loinger, Kramsach (AT); Günther Blasbichler, Innsbruck (AT)

(73) Assignee: D. Swarovski KG, Wattens (AT)

( * ) Notice: Subject to any disclaimer, the term of this patent is extended or adjusted under 35 U.S.C. 154(b) by 0 days.

(21) Appl. No.: 16/753,548

(22) PCT Filed: Oct. 9, 2018

(86) PCT No.: PCT/EP2018/077494
§ 371 (c)(1),
(2) Date: Apr. 3, 2020

(87) PCT Pub. No.: WO2019/072857
PCT Pub. Date: Apr. 18, 2019

(65) Prior Publication Data

US 2020/0288827 A1 Sep. 17, 2020

(30) Foreign Application Priority Data

Oct. 9, 2017 (EP) ..... 17195553

(51) Int. Cl.
*A44C 17/00* (2006.01)

(52) U.S. Cl.
CPC ..... *A44C 17/001* (2013.01)

(58) Field of Classification Search
CPC ..... A44C 17/001
USPC ..... D11/90; 63/32
See application file for complete search history.

(56) References Cited

U.S. PATENT DOCUMENTS

| | | | | | |
|---|---|---|---|---|---|
| 693,084 | A | * | 2/1902 | Townsend | A44C 17/001 63/32 |
| 3,788,097 | A | | 1/1974 | Elbe | |
| D267,569 | S | * | 1/1983 | Polite | D11/90 |
| D434,691 | S | * | 12/2000 | Swarovski | D11/90 |
| D483,686 | S | * | 12/2003 | Bamminger | D11/90 |
| D501,423 | S | * | 2/2005 | Tolkowsky | D11/90 |

(Continued)

FOREIGN PATENT DOCUMENTS

| | | | |
|---|---|---|---|
| CN | 102525050 | A | 7/2012 |
| CN | 104287329 | A | 1/2015 |

(Continued)

OTHER PUBLICATIONS

Extended European Search Report; European Application No. 17195553.7; dated Apr. 5, 2018; European Patent Office; Munich, Germany.

(Continued)

*Primary Examiner* — Jack W Lavinder
(74) *Attorney, Agent, or Firm* — Stevens & Showalter LLP

(57) ABSTRACT

The invention relates to a gemstone cut, comprising a crown having a flat table and main crown facets (10-12) being arranged around the table (1) and being inclined relative to the table, a girdle (5) at which the gemstone has its largest transverse dimension, and a pavilion adjoining the girdle from below the girdle and having main pavilion facets (7) around the girdle, whereby the number of the main pavilion facets is odd. The invention also relates to an article comprising a gemstone according to the invention and a method for improving the optical properties of a gemstone.

19 Claims, 4 Drawing Sheets

(56) References Cited

U.S. PATENT DOCUMENTS

| | | | | | |
|---|---|---|---|---|---|
| D589,393 | S | * | 3/2009 | Swarovski | D11/90 |
| D595,605 | S | * | 7/2009 | Schneider | D11/90 |
| D616,327 | S | * | 5/2010 | Schneider | D11/90 |
| D688,155 | S | * | 8/2013 | Stuchlik | D11/90 |
| D691,916 | S | * | 10/2013 | Stuchlik | D11/90 |
| 2002/0007648 | A1 | | 1/2002 | Bamminger | |

FOREIGN PATENT DOCUMENTS

| | | | |
|---|---|---|---|
| CN | 104797159 | A | 7/2015 |
| CN | 105831905 | A | 8/2016 |
| CN | 206025439 | U | 3/2017 |
| FR | 573953 | A | 7/1924 |
| NL | 7104136 | A | 9/1971 |
| WO | 2014056008 | A1 | 4/2014 |

OTHER PUBLICATIONS

International Search Report and Written Opinion of the International Searching Authority; International Application No. PCT/EP2018/077494; dated Nov. 30, 2018; European Patent Office; Rijswijk, Netherlands.

Search Report; Chinese Application No. 2018800661636; dated Mar. 26, 2021; China National Intellectual Property Administration; Beijing, China.

Office Action; Chinese Application No. 2018800661636; dated Apr. 6, 2021; China National Intellectual Property Administration; Beijing, China.

Zhao Xiangrui; Office Action; Chinese application No. 201880066163.6; dated Jan. 13, 2022; Chinese National Intellectual Property Administration; Beijing, China.

Third Office Action dated Jun. 20, 2022; Chinese Application No. 201880066163.6; The State Intellectual Property Office of People's Republic of China; Beijing, China.

* cited by examiner

CUT FOR GEMSTONE

FIELD OF THE INVENTION

The invention concerns a cut for a gemstone and, in particular, a gemstone having a pavilion and an odd number of main pavilion facets.

BACKGROUND ART

Optical properties and especially brilliance (v.i.) are valued characteristics of a faceted cut gemstone. So far various and different kind of cuts have been developed. The brilliant cut in combination with the diamond is very well known and enhances the brilliance (v.i.) of a diamond. The high refractive index of the diamond is a physical quantity which influences the way light is reflected by the diamond and enables a very esthetical appearance of the faceted cut diamond. In general, the brilliant cut is a very popular cut and therefore very often used in combination with other gemstone materials.

A gemstone with a brilliant cut includes a crown, the top part of the gemstone, with a table and 8 main crown facets, and a pavilion, the bottom part of the gemstone, with 8 main pavilion facets. The pavilion encompasses in addition to the main pavilion facet also a second type of pavilion facet.

From the prior art, different types of facetted cuts for different gemstone materials are already known.

The application EP 2436281 A1 discloses a brilliant cut for cubic zirconia with changed angle values, which is intended to imitate the appearance of a diamond with a brilliant cut.

According to the patent application WO 2014/056008 A1, a cut with 8 main crown facets and 8 main pavilion facets for topaz is disclosed. From this document it is already known that a pavilion with 3 types of pavilion facets can improve the brilliance of the gemstone.

The object of the invention is to provide a faceted cut gemstone with improved optical properties for the gemstone. Another object is to provide a faceted cut gemstone with improved optical properties which retains a visual appearance that is comparable with a brilliant cut gemstone.

SUMMARY OF THE INVENTION

One or more of the objects of the invention are provided with a gemstone according to the invention.

In one aspect, the invention provides a gemstone, comprising a) a crown having a flat table and main crown facets being arranged around the table and being inclined relative to the table, b) a girdle at which the gemstone has its largest transverse dimension, and c) a pavilion adjoining the girdle from below the girdle and having main pavilion facets around the girdle, characterized in that the number of the main pavilion facets is odd.

The invention also encompasses an article comprising a gemstone according to the invention, and a decorative article comprising a gemstone according to the invention The dependent claims are preferred embodiments of the invention.

Surprisingly, it has been found that a cut for a gemstone in which there is an odd number of pavilion facets provides one or more improved optical properties over a similar gemstone having an even number of main pavilion facets.

Due to the odd number of pavilion facets the optical properties, especially the brilliance, are improved. In a preferred embodiment, the number of the main crown facets differs from the number of the main pavilion facets. In this way, the benefits of the invention may be maintained, while the visual appearance of the gemstone (when viewed towards the crown, as is typical in articles comprising such gemstones) retains the pleasing esthetic characteristics of a traditional gemstone.

In the following the angles of the inclined facets refer to an imaginary plane which is parallel to the table (table plane). There are two possible angles between a facet and the table plane, a larger angle and a smaller one. The smaller angle is the acute angle, and this acute angle is the relevant angle for the purposes of the present description.

Physical properties like the refractive index influence the path of the light through a gemstone. In a preferred embodiment, the refractive index is at least about 1.45, particularly preferred at least about 1.5 and not more than about 1.8, and very particularly preferred at least about 1.55 and not more than about 1.7. The preferred embodiments of the refractive index may further increase the brilliance (v.i.) of the gemstone.

Preferred gemstones in the context of the present invention are made of topaz or glass ceramic. Such desirable gemstones may have a refractive index within the preferred ranges of the invention. Topaz is a silicate mineral of aluminum and fluorine with the chemical formula $Al_2SiO_4(F,OH)_2$. Glass ceramic is a material with an amorphous phase and one or more crystalline phases, which is produced by a controlled crystallization. It is mostly produced in two steps. First, a glass is formed by a glass-manufacturing process. The glass is cooled down and is then reheated in a second step. In this heat treatment, the glass partly crystallizes.

Other possible gemstone materials include, but are not limited to, glass, quartz, garnet or corundum, such as sapphire or ruby.

In some embodiments the number of main pavilion facets may be 7, 9 or 11; and is most suitably 7, which has been found to particularly increase the amount of reflected light within the gemstone.

In some embodiments of the invention the number of the main crown facets is even, which may achieve improved fire (v.i.) and/or light return (v.i.). Preferably the number of main crown facets is 8, 10 or 12.

According to one embodiment of the invention the number of main pavilion facets of the gemstone is 7, and the number of the main crown facets of the gemstone is 8.

In another embodiment of the invention the number of main pavilion facets is 7, and the number of the main crown facets is 7, 9 or 11, which may increase the brilliance (v.i.) of the gemstone.

It has been found that the fire (v.i.) and light return (v.i.) of a gemstone according to the invention can be further increased when the angle of the main pavilion facets of the gemstone with respect to the table plane is between about 41° and about 45°, particularly between about 42° and about 44.5°, and preferably between about 42.4° and about 44°.

According to the invention it has been found that a second type of pavilion facet that adjoins the girdle and the main pavilion facets may further increase the fire (v.i.) and the light return (v.i.) of the gemstone. In some embodiments, the angle of the second type of pavilion facet with respect to the table plane is between about 45° and about 48°, preferably between about 46° and about 47.5°. The number of the second type of pavilion facets is suitably equal to the number of the main pavilion facets. It may also be possible to achieve an advantage by including a third type of pavilion facet which adjoins the main pavilion facets and forms a point or a rounded point at the bottom of the gemstone. The angle of the third type of pavilion facet with respect to the table plane, where included, is preferably between about 35° and about 40°, and particularly preferably between about 37.5° and about 39.5°. Suitably, the number of the third type of pavilion facet is equal to the number of the main pavilion facets.

In a particularly preferred gemstone according to the invention, the pavilion comprises main pavilion facets having an angle with respect to the table plane of between about 41° and about 45°, preferably between about 42° and about 44.5° and particularly preferably between about 42.4° and about 44°; a second type of pavilion facet having an angle with respect to the table plane of between about 45° and about 48°, preferably between about 46° and about 47.5°; and a third type of pavilion facet having an angle with respect to the table plane of between about 35° and about 40°, preferably between about 37.5° and about 39.5°.

A method of improving the optical properties of a gemstone is also provided, the method comprising cutting a gemstone to provide an odd number of main pavilion facets. The gemstone manufactured according to the methods of the invention may have any of the features of the gemstones of the invention as described herein. The improved optical properties may include light return and/or fire. Beneficially the gemstone has an even number of main crown facets and/or most desirably has the appearance of a brilliant cut gemstone when viewed generally from above (i.e. towards the table). A most preferred gemstone to be improved by the methods of the invention is a topaz.

FIGURES

Further details and advantages of the present invention are described more fully hereinafter by means of the specific description with reference to the drawings.

FIGS. 1*a* to 1*c* show, respectively, a plan view, a side view and a view from below of a gemstone according to the invention with 7 main pavilion facets and 8 main crown facets (termed 'cut C8P7' herein).

FIGS. 2*a* to 2*c* show, respectively, a plan view, a side view and a view from below of a gemstone according to the invention with 7 main pavilion facets and 7 main crown facets (termed 'cut C7P7' herein).

FIGS. 3*a* to 3*c* show, respectively, a plan view, a side view and a view from below of a gemstone with 8 main pavilion facets and 8 main crown facets (termed 'cut C8P8' herein).

Figure 1A:
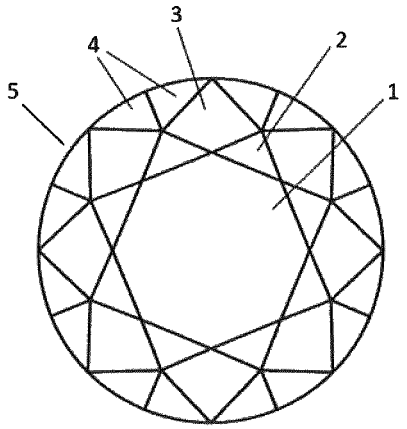

The reference signs in the figures have the following meaning:

(1), (9) or (17): table
(2), (10) or (18): second type of crown facet (star facet)
(3), (11) or (19): main crown facets
(4), (12) or (20): third type of crown facet (upper girdle facet)
(5), (13) or (21): girdle
(6), (14) or (22): second type of pavilion facet
(7), (15) or (23): main pavilion facets
(8), (16) or (24): third type of pavilion facet
(25): position of the gemstone for measuring its light return
(26): base circle of the light return setup
(27): hemisphere
(28): incident light beams
(29): open part of the hemisphere
(30) observing center part
(α): aperture angle of the open part of the hemisphere (29)
(β): aperture angle of the observing center part (30) to determine the light return
(31): position of the gemstone for measuring its fire
(32): position of the light source
(33): reflected light beams
(34): observing surface to calculate the fire

DESCRIPTION OF THE INVENTION

The term 'brilliance' encompasses the so-called 'fire' and the 'light return' of a gemstone. The 'fire' of a gemstone is a measure of the ability of the gemstone to separate an incident white light into its spectral components (v.i.). The 'light return' of a gemstone is a measure of how much of an incident light reflects back to the viewer in a predefined solid angle range substantially along the axis of symmetry of the gemstone (v.i.). A further characteristic quantity of the optical properties of a gemstone is the 'scintillation', which is a measure of the brightness and the contrast of the light issuing from the gemstone. In general, for the fire, light return and scintillation, the reflection and refraction of the light within the gemstone is an important mechanism.

According to the invention it has been found that crown facets within suitable angle ranges can increase the amount of the reflected light, especially the fire and the light return. Beneficially, the angle of the main crown facets with respect to the table plane may be between about 27° and about 38°, particularly between about 30° and about 34.5°. A second type of crown facet, the so-called star facet, may contribute to increasing the fire and light return and may have an angle with respect to the table plane of between about 15° and about 28.5°, particularly between about 15.5° and 27°. The number of the second type of crown facets is preferably equal to the number of the main crown facets. In some advantageous embodiments, a third type of crown facet, the so-called upper girdle facet, may be provided and may contribute to increasing the value of brilliance that is achievable. When provided, the third type of crown facet may have an angle with respect to the table plane of between about 34° and about 45°, particularly between about 36° and about 41.5°. According to embodiments of the invention the number of the third type of crown facets is preferably equal to the double number of the main crown facets.

Furthermore, in a preferred embodiment the crown comprises the main crown facets with an angle with respect to the table plane between about 27° and about 38°, preferably between about 30° and about 34.5°; and a second type of crown facet with an angle with respect to the table plane between about 15° and about 28.5°; preferably between about 15.5° and 27°; and a third type of crown facet with an angle with respect to the table plane between about 34° and about 45°, preferably between about 36° and about 41.5°. A faceted cut gemstone with these three types of crown facets provides the further advantage that is has, when viewed from above (e.g. in the plan view), a geometrical shape similar to that of a brilliant cut.

FIGS. 1*a* to 1*c* and 2*a* to 2*c* (v.i.) shows embodiments of a gemstone according to the invention. The gemstones include a table (1, 9), main crown facets (3, 11), a girdle (5, 13), and main pavilion facets (7, 15). According to the invention the number of the main pavilion facets (7, 15) is odd. For comparisons reasons FIGS. 3*a* to 3*b* show a gemstone cut according to the prior art, having an even number of main crown facets and an even number of main pavilion facets.

According to the depicted embodiments, the girdle, which represents the largest transverse dimension of the gemstone is in the form of a narrow peripheral edge between the crown and the pavilion. Nevertheless, the girdle could also be in the form of a sharp edge. In a preferred embodiment, the girdle has an approximately round shape and then the gemstone is a so-called round gemstone.

It has been found that, according to embodiments of the invention, beneficially high values of light return and fire can be achieved when the diameter of the circumscribed circle of the table is between about 45% and about 70% of the diameter of the circumscribed circle of the girdle, preferably between about 55% and 65%. The end of the pavilion can be in the form of a point or in the form of a rounded point, a so-called culet.

EXAMPLES

A person skilled in the art understands that computer simulation programs can be used to calculate the fire and light return of different cuts of gemstones. In the following Examples, the simulation program used was the ray tracing software SPEOS from OPTIS. This is a well-known computer program, which is used in different technical fields of optics, e.g. in the automotive industry to assay headlamps. Another applicable ray tracing computer program would be, for instance, TracePro from Lambda Research. For the sake of completeness, it should be appreciated that gemstones can also be physically assayed using appropriate apparatus, as is known to the skilled person in the art. In the following examples, the refractive index of the gemstone material used during the computer simulations had a value of n=1.62.

Light Return

Figure 4:
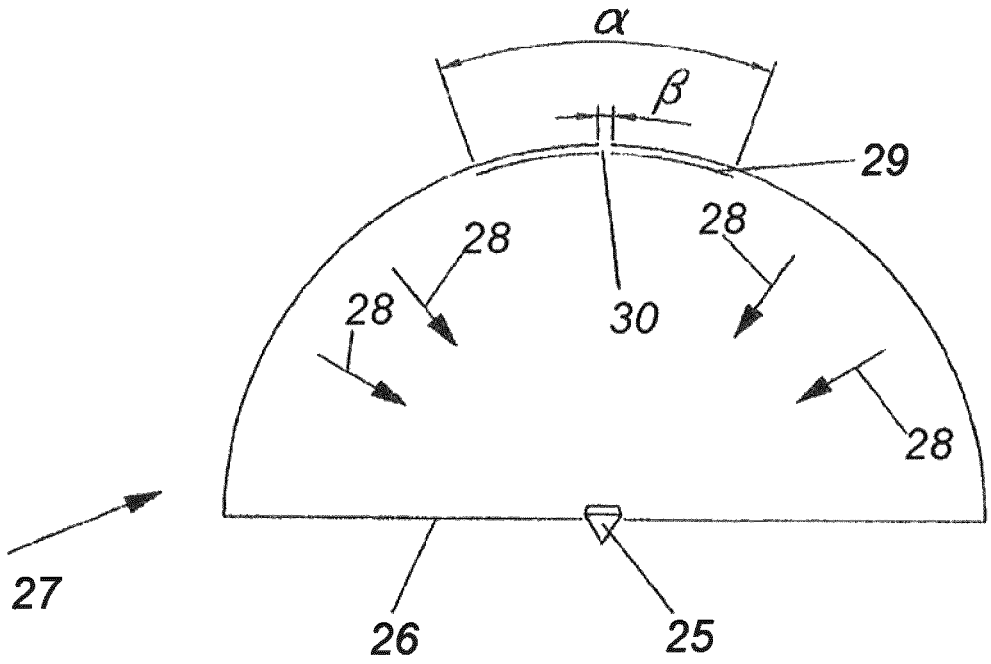
FIG. 4 is a schematic illustration of an arrangement to illuminate a gemstone and to calculate the light return of the gemstone.

The simulation setup to calculate light return encompasses a diffuse light source to allow light to illuminate the gemstone evenly from all appropriate directions. For this reason, a hemispherical illumination arrangement, as shown in FIG. 4, was used. The gemstone (25) was arranged at the center of a base circle (26) of a hemisphere (27) in a way such that the crown of the gemstone was irradiated with diffuse light (28), which was emitted from the hemisphere (27). No light was incoming on the gemstone from below the base circle (26). A central part of the hemisphere (29) with an aperture angel $\alpha$ of 2×23°, i.e. 46°, is 'open' and was excluded as a source of illumination, because this region of the hemisphere is necessary for viewing the gemstone (25) from above. Thus, the open part (29) is covered with the head of an observer (not shown). The center part of the hemisphere (27) is symmetrical about an axis through the center of the base circle (26) whereby the axis is perpendicular to the base circle. An additional inner observing center part (30) at the center of the open part (29), with an aperture angle $\beta$ of 2×1.5°, i.e. 3°, is used to determine the value of the reflected light return with regard to the incident light. The observing center part (30) of the hemisphere (27) is also arranged symmetrically about the axis through the center of the base circle whereby the axis is perpendicular to the base circle. This is a concept of light return which is known by a person skilled in the art and is used by the Gemological Institute of America (GIA).

Fire

Figure 5:
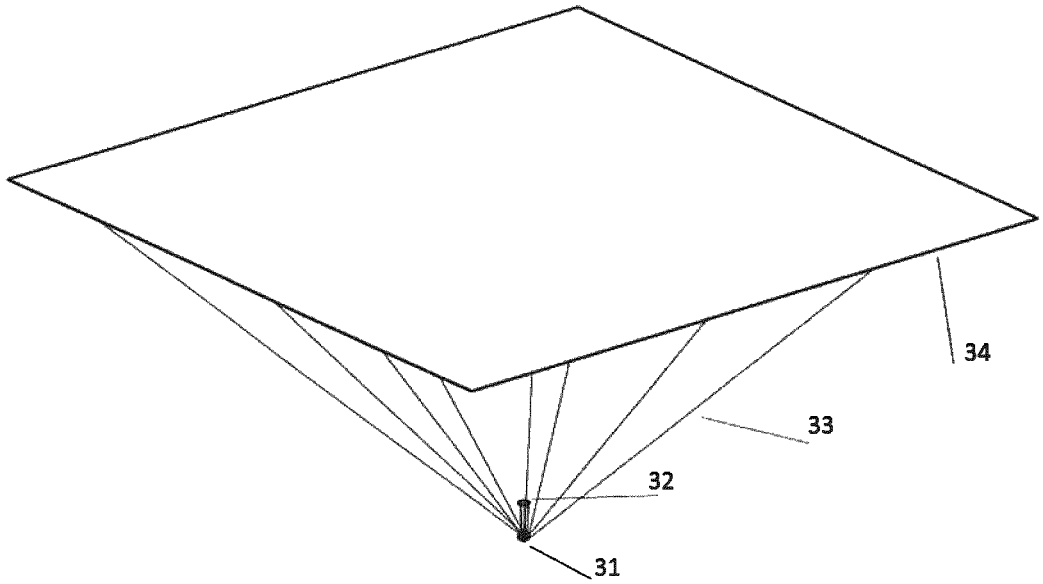
FIG. 5 is a schematic illustration of an arrangement to illuminate a gemstone and measure the fire of the gemstone.

FIG. 5 shows the simulation setup to obtain the fire of a gemstone (31) by measurement and calculation. The gemstone (31) was illuminated by a light source (32), which was a directed white light source. The aperture angle of the light source (32) was 2×0.25°, i.e. 0.5°. Light beams (33) are reflected by the gemstone. Due to its reflection by the gemstone the incident white light is separated into its components and the reflected light beams (33) hit an observing surface (34). The size of the observing surface (34) was in this simulation 1 m×1 m, and the distance from the gemstone was 0.5 m from the center of the observing surface (34) to the table of the gemstone measured in an axial direction perpendicular to the plane of the observing surface (34). A person skilled in the art readily understands and knows how to employ such methods. From the light distribution captured on the observing surface (34) the saturation and the illuminance of the reflected light beams was calculated. The product values of saturation and illuminance of the reflected light beams are totaled and in relation to the totaled illuminance values thus give the value for the fire, i.e.:

$$\text{Fire}=100\times((\Sigma(\text{saturation}\times\text{illuminance}))/(\Sigma\text{illuminance})).$$

Results

Example 1

Figure 3A:
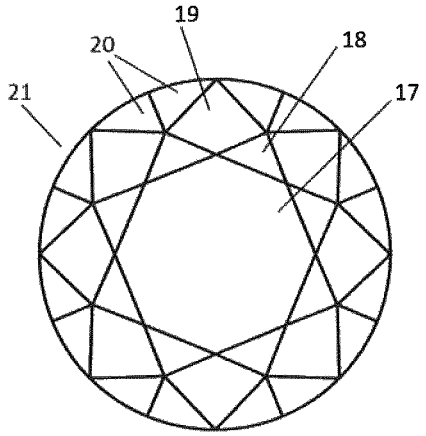
Figure 3B:
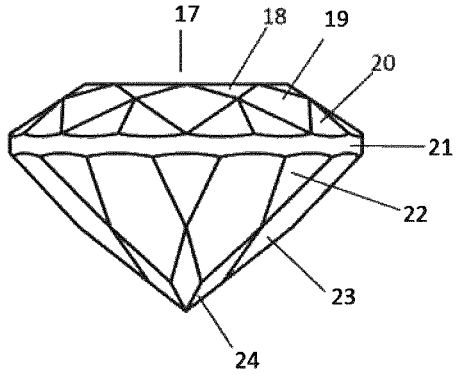
Figure 3C:
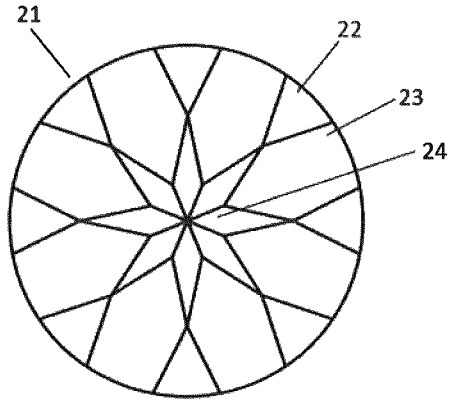

A gemstone having a prior art number of crown and pavilion facets; in this case, 8 main crown facets and 8 main pavilion facets (termed C8P8 herein), see FIGS. 3*a* to 3*c*, was simulated and assayed.

The main parameters of the C8P8 gemstone were as follows:

- The diameter of the circumscribed circle of the table (FIG. 3*a*, 17) was 56.9% of the diameter of the circumscribed circle of the girdle.
- The number of main pavilion facets (FIG. 3*c*, 23) was 8 and their angle was 43.56°.
- The number of the second type of pavilion facets (FIG. 3*c*, 22) was 8 and their angle was 46.55°.
- The number of the third type of pavilion facets (FIG. 3*c*, 24) was 8 and their angle was 38.55°
- The number of the main crown facets (FIG. 3*a*, 19) was 8 and their angle was 33.33°.
- The number of the second type of crown facets (FIG. 3*a*, 18) was 8 and their angle was 20.07°
- The number of the third type of crown facets (FIG. 3*a*, 20) was 16 and their angle was 39.53°.

Using the assays described herein, the calculated light return was 0.0375% and the calculated fire was 28.743%.

Example 2

Figure 2A:
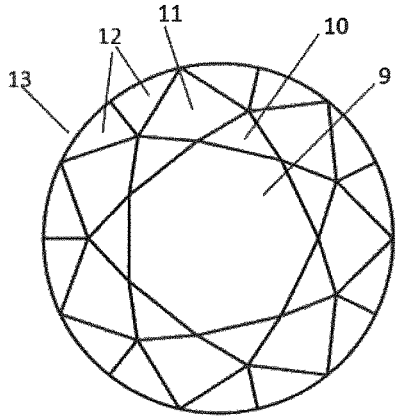
Figure 2B:
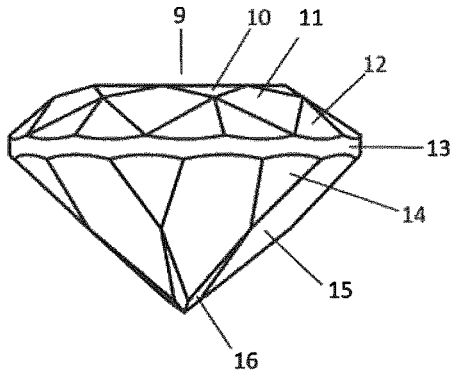
Figure 2C:
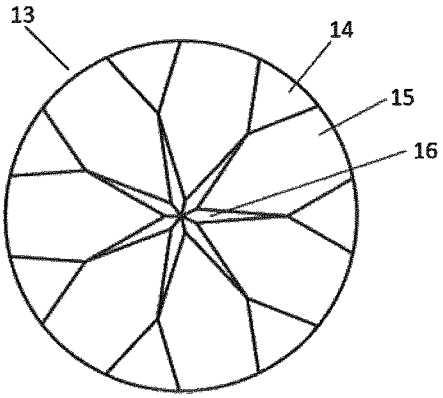

A gemstone according to the invention, having 7 main crown facets and 7 main pavilion facets, termed C7P7 (i.e. having an odd number of pavilion facets and an odd number of crown facets), as depicted in FIGS. 2*a* to 2*c* was simulated and assayed.

The main parameters of the C7P7 gemstone were as follows:

- The diameter of the circumscribed circle of the table (FIG. 2*a*, 9) was 56.9% of the diameter of the circumscribed circle of the girdle.
- The number of main pavilion facets (FIG. 2*c*, 15) was 7 and their angle was 42.59°.

The number of the second type of pavilion facets (FIG. 2*c*, 14) was 7 and their angle was 46.55°.

The number of the third type of pavilion facets (FIG. 2*c*, 16) was 7 and their angle was 38.55°

The number of the main crown facets (FIG. 2*a*, 11) was 7 and their angle was 33.33°.

The number of the second type of crown facets (FIG. 2*a*, 10) was 7 and their angle was 16.14°

The number of the third type of crown facets (FIG. 2*a*, 12) was 14 and their angle was 41.02°.

Using the assay systems described herein, the calculated light return was 0.2311% and the calculated fire was 54.225%. Thus, the C7P7 gemstone of the invention exhibits approx. 6.16 times more light return than the C8P8 gemstone, and approx. 1.89 times more fire than the cut C8P8.

Example 3

Figure 1B:
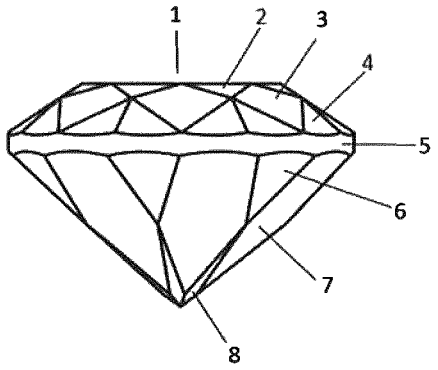
Figure 1C:
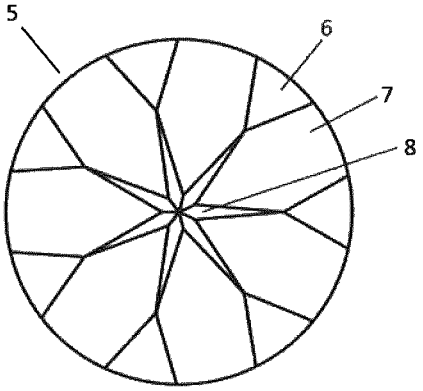

A gemstone according to the invention, having 8 main crown facets and 7 main pavilion facets, termed C8P7 (i.e. having an odd number of pavilion facets and an even number of crown facets), as depicted in FIGS. 1*a* to 1*c* was simulated and assayed.

The main parameters of the C8P7 gemstone were as follows:

The diameter of the circumscribed circle of the table (FIG. 1*a*, 1) was 56.9% of the diameter of the circumscribed circle of the girdle.

The number of main pavilion facets (FIG. 1*c*, 7) was 7 and their angle was 42.59°.

The number of the second type of pavilion facets (FIG. 1*c*, 6) was 7 and their angle was 46.55°.

The number of the third type of pavilion facets (FIG. 1*c*, 8) was 7 and their angle was 38.55°

The number of the main crown facets (FIG. 1*a*, 3) was 8 and their angle was 33.33°.

The number of the second type of crown facets (FIG. 1*a*, 2) was 8 and their angle was 20.07°.

The number of the third type of crown facets (FIG. 1*a*, 4) was 16 and their angle was 39.53°.

Using the assay systems described herein, the calculated light return was 0.2078% and the calculated fire was 54.033%. Thus, the C8P7 gemstone of the invention exhibits approx. 5.54 times more the light return than the C8P8 gemstone and approx. 1.88 times more fire than the C8P8 gemstone.

Example 4

A gemstone according to the invention, having 9 main crown facets and 7 main pavilion facets, termed C9P7 (i.e. having an odd number of pavilion facets and an odd number of crown facets) was simulated and assayed.

The main parameters of the C9P7 gemstone were as follows:

The diameter of the circumscribed circle of the table was 56.9% of the diameter of the circumscribed circle of the girdle.

The number of main pavilion facets was 7 and their angle was 42.59°.

The number of the second type of pavilion facets was 7 and their angle was 46.55°.

The number of the third type of pavilion facets was 7 and their angle was 38.55°

The number of the main crown facets was 9 and their angle was 33.33°.

The number of the second type of crown facets was 9 and their angle was 22.82°.

The number of the third type of crown facets was 18 and their angle was 38.41°.

Using the assays described herein, the calculated light return was 0.2097% and the calculated fire was 53.360%. Thus, the C9P7 gemstone of the invention exhibits approx. 5.59 times more light return than the C8P8 gemstone and approx. 1.86 times more fire than the C8P8 gemstone.

Example 5

A gemstone according to the invention, having 10 main crown facets and 7 main pavilion facets, termed C10P7 (i.e. having an odd number of pavilion facets and an even number of crown facets) was simulated and assayed.

The main parameters of the C10P7 gemstone were as follows:

The diameter of the circumscribed circle of the table) was 56.9% of the diameter of the circumscribed circle of the girdle.

The number of main pavilion facets was 7 and their angle was 42.59°.

The number of the second type of pavilion facets was 7 and their angle was 46.55°.

The number of the third type of pavilion facets was 7 and their angle was 38.55°

The number of the main crown facets was 10 and their angle was 33.33°.

The number of the second type of crown facets was 10 and their angle was 24.81°.

The number of the third type of crown facets was 20 and their angle was 37.56°.

Using the assay systems described herein, the calculated light return was 0.2198% and the calculated fire was 52.887%. Thus, the C10P7 gemstone of the invention exhibits approx. 5.86 times more light return than the C8P8 gemstone and approx. 1.84 times more fire than the cut C8P8 gemstone.

Example 6

A gemstone according to the invention, having 11 main crown facets and 7 main pavilion facets, termed C11P7 (i.e. having an odd number of pavilion facets and an odd number of crown facets) was simulated and assayed.

The main parameters of the C11P7 gemstone were as follows:

The diameter of the circumscribed circle of the table was 56.9% of the diameter of the circumscribed circle of the girdle.

The number of main pavilion facets was 7 and their angle was 42.59°.

The number of the second type of pavilion facets was 7 and their angle was 46.55°.

The number of the third type of pavilion facets was 7 and their angle was 38.55°

The number of the main crown facets was 11 and their angle was 33.33°.

The number of the second type of crown facets was 11 and their angle was 26.28°.

The number of the third type of crown facets was 22 and their angle was 36.9°.

Using the assay systems described herein, the calculated light return was 0.1924% and the calculated fire was 52.047%. Thus the C11P7 gemstone of the invention exhibits approx. 5.13 times more light return than the C8P8 gemstone and approx. 1.81 times more fire than the C8P8 gemstone.

Example 7

A gemstone according to the invention, having 12 main crown facets and 7 main pavilion facets, termed C12P7 (i.e. having an odd number of pavilion facets and an even number of crown facets) was simulated and assayed.

The main parameters of the C12P7 gemstone were as follows:

The diameter of the circumscribed circle of the table was 56.9% of the diameter of the circumscribed circle of the girdle.

The number of main pavilion facets was 7 and their angle was 42.59°.

The number of the second type of pavilion facets was 7 and their angle was 46.55°.

The number of the third type of pavilion facets was 7 and their angle was 38.55°

The number of the main crown facets was 12 and their angle was 33.33°.

The number of the second type of crown facets was 12 and their angle was 27.41°.

The number of the third type of crown facets was 24 and their angle was 36.38°.

Using the assay systems described herein, the calculated light return was 0.2012% and the calculated fire was 52.182%. Thus, the C12P7 gemstone of the invention exhibits approx. 5.37 times more light return than the C8P8 gemstone and approx. 1.82 times more fire than the C8P8 gemstone.

Example 8

A gemstone according to the invention, having 8 main crown facets and 9 main pavilion facets, termed C8P9 (i.e. having an odd number of pavilion facets and an even number of crown facets) was simulated and assayed.

The main parameters of the C8P9 gemstone were as follows:

The diameter of the circumscribed circle of the table was 56.9% of the diameter of the circumscribed circle of the girdle.

The number of main pavilion facets was 9 and their angle was 44.40°.

The number of the second type of pavilion facets was 9 and their angle was 46.55°.

The number of the third type of pavilion facets was 9 and their angle was 38.55°

The number of the main crown facets was 8 and their angle was 33.33°.

The number of the second type of crown facets was 8 and their angle was 20.07°.

The number of the third type of crown facets was 16 and their angle was 39.53°.

Using the assay systems described herein, the calculated light return was 0.0834% and the calculated fire was 38.883%. Thus, the C8P9 gemstone of the invention exhibits approx. 2.22 times more light return than the C8P8 gemstone and approx. 1.35 times more fire than the C8P8 gemstone.

Example 9

A gemstone according to the invention, having 10 main crown facets and 9 main pavilion facets, termed C10P9 (i.e. having an odd number of pavilion facets and an even number of crown facets) was simulated and assayed.

The main parameters of the C10P9 gemstone were as follows:

The diameter of the circumscribed circle of the table was 56.9% of the diameter of the circumscribed circle of the girdle.

The number of main pavilion facets was 9 and their angle was 44.40°.

The number of the second type of pavilion facets was 9 and their angle was 46.55°.

The number of the third type of pavilion facets was 9 and their angle was 38.55°

The number of the main crown facets was 10 and their angle was 33.33°.

The number of the second type of crown facets was 10 and their angle was 24.81°.

The number of the third type of crown facets was 20 and their angle was 37.56°.

Using the assay systems described herein, the calculated light return was 0.0873% and the calculated fire was 41.027%. Thus, the C10P9 gemstone of the invention exhibits approx. 2.33 times more light return than the C8P8 gemstone and approx. 1.43 times more fire than the C8P8 gemstone.

Accordingly, gemstones according to the invention, in particular, gemstones having an odd number (e.g. 7 or 9) main pavilion facets exhibit improved optical properties—especially in relation to fire and light return, when compared to similar gemstones having an even number (e.g. 8) main pavilion facets.

The invention claimed is:

1. A gemstone, comprising a) a crown having a flat table and main crown facets being arranged around the table and being inclined relative to the table, b) a girdle at which the gemstone has its largest transverse dimension, and c) a pavilion adjoining the girdle from below the girdle and having main pavilion facets around the girdle, characterized in that the main pavilion facets have the same size and shape and adjoin the girdle along a side of the main pavilion facet, and wherein the number of the main pavilion facets is 7 and the number of the main crown facets differs from the number of the main pavilion facets.

2. The gemstone as set forth in claim 1, wherein the number of the main crown facets is even.

3. The gemstone according to claim 1, wherein the number of the main crown facets is 8, 10 or 12.

4. The gemstone as set forth in claim 1, wherein the number of the main crown facets is 9 or 11.

5. The gemstone according to claim 1, wherein the refractive index is (a) at least about 1.45; or (b) at least about 1.5 and not more than about 1.8.

6. The gemstone according to claim 1, wherein the gemstone is made of topaz, glass ceramic, glass, quartz, garnet, or corundum.

7. The gemstone according to claim 1, wherein the angle of the main pavilion facets of the gemstone with respect to the table plane is (a) between about 41° and about 45°; or (b) between about 42° and about 44.5°.

8. The gemstone according to claim 1, wherein a second type of pavilion facets adjoins the girdle and the main pavilion facets.

9. The gemstone as set forth in claim 8, wherein the angle of the second type of pavilion facets of the gemstone with respect to the table plane is (a) between about 45° and about 48°; or (b) between about 46° and about 47.5°.

10. The gemstone according to claim 8, wherein a third type of pavilion facets adjoins the main pavilion facets and form a point or a rounded point.

11. The gemstone as set forth in claim 10, wherein the angle of the third type of pavilion facets of the gemstone with respect to the table plane is (a) between about 35° and about 40°; or (b) between about 37.5° and about 39.5°.

12. An article, comprising a gemstone according to claim 1.

13. A method for improving the optical properties of a gemstone, the gemstone having:

a) a crown having a flat table and main crown facets being arranged around the table and being inclined relative to the table, b) a girdle at which the gemstone has its largest transverse dimension, and c) a pavilion adjoining the girdle from below the girdle and having main pavilion facets around the girdle, the method comprising cutting the gemstone to provide an odd number of 7 main pavilion facets and a different number of main crown facets; and wherein the main pavilion facets have the same size and shape and adjoin the girdle along a side of the main pavilion facet.

14. The method as set forth in claim 13, wherein the gemstone is cut to provide an even number of main crown facets.

15. The method as set forth in claim 13, wherein the gemstone is cut to provide 8, 9, 10, 11 or 12 main crown facets.

16. A gemstone, comprising a) a crown having a flat table and main crown facets being arranged around the table and being inclined relative to the table, b) a girdle at which the gemstone has its largest transverse dimension, and c) a pavilion adjoining the girdle from below the girdle and having main pavilion facets around the girdle, characterized in that the main pavilion facets have the same size and shape and adjoin the girdle along a side of the main pavilion facet, and wherein the number of the main pavilion facets is odd and the number of the main crown facets is even.

17. The gemstone according to claim 16, wherein the number of main pavilion facets is 7.

18. The gemstone according to claim 16, wherein the number of the main crown facets is 8, 10 or 12.

19. The gemstone according to claim 16, wherein the gemstone is made of topaz, glass ceramic, glass, quartz, garnet or corundum.

* * * * *